US005417429A

United States Patent [19]

Strand

[11] Patent Number: 5,417,429

[45] Date of Patent: May 23, 1995

[54] GOLF PUTTER

[76] Inventor: Lennart Strand, Hovas Herrgardsväg 1, S-436 50 Hovas, Sweden

[21] Appl. No.: 245,543

[22] Filed: May 18, 1994

[30] Foreign Application Priority Data

May 28, 1993 [SE] Sweden ..... 9301864

[51] Int. Cl.[6] ..... A63B 53/04; A63B 69/36

[52] U.S. Cl. ..... 273/187.4; 273/164.1

[58] Field of Search ..... 273/167 R, 167 A, 167 B, 273/167 D, 167 E, 167 F, 167 G, 167 H, 167 J, 167 K, 168, 169, 170–175, 193 R, 194 R, 164.1, 187.4, 186.2, 77 A, 77 R, 79, 78, 194 A; D21/214–219

[56] References Cited

U.S. PATENT DOCUMENTS

| | | | |
|---|---|---|---|
| D. 191,211 | 8/1961 | Forest | 273/167 F |
| 1,690,388 | 11/1928 | Waldron | 273/164.1 |
| 3,143,349 | 8/1964 | MacIntyre | 273/167 R |
| 3,448,981 | 6/1969 | Anweiler | 273/164. |
| 3,921,984 | 11/1975 | Winter . | |
| 4,034,989 | 7/1977 | Stewart . | |
| 4,121,833 | 10/1978 | Prueter | 273/167 C |
| 4,290,606 | 9/1981 | Maxwell | 273/175 |
| 4,369,974 | 1/1983 | Komperda . | |
| 4,383,690 | 5/1983 | Maxwell | 273/175 |
| 4,580,784 | 4/1986 | Brill | 273/169 |
| 4,650,191 | 3/1987 | Mills . | |
| 4,659,083 | 4/1987 | Szczepanski . | |
| 4,741,535 | 5/1988 | Leonhardt . | |
| 4,846,477 | 7/1989 | Phelan | 273/175 |
| 4,852,879 | 8/1989 | Collins | 273/164.1 |
| 4,871,174 | 10/1989 | Kobayashi | 273/164.1 |
| 4,921,660 | 5/1990 | Kryter . | |
| 5,127,653 | 7/1992 | Nelson | 273/167 C |

FOREIGN PATENT DOCUMENTS 2124090 2/1984 United Kingdom .

*Primary Examiner*—Sebastiano Passaniti

[57] ABSTRACT

A golf putter has a head (1) with a planar striking face (5). The putter head has aiming assisting elements (3, 3', 4 4') which comprise at least two portions (4, 4') each extending rearwardly with respect to the striking face of the putter head such that when seen from above and in a rearward direction, said two portions (4, 4') diverge outwardly. In order to assist increased accuracy when aiming, the two portions are arranged at such an angle to the striking face that the virtual extension (CG, DG) of each portion in a direction forward of the striking face (5) is substantially tangential to a standard golf ball placed at the striking face.

14 Claims, 3 Drawing Sheets

GOLF PUTTER

FIELD OF THE INVENTION

The invention relates to a golf putter. More particularly the invention relates to a putter head for a golf putter, a putter head with a shaft stem and to a complete golf putter.

BACKGROUND TO THE INVENTION

A golf putter is known from U.S. Pat. No. 4,034,989 having a putter head comprising a planar striking face and aiming assisting means, wherein said aiming assisting means have two portions extending in a rearward direction with respect to the striking face and wherein, seen from above and in said rearward direction, said at least two portions diverge outwardly, each of said at least two portions having a virtual extension in a direction forward of said striking face which meet at a point of convergence. This document thus discloses a golf putter having, in particular, on the opposite side to the striking face of the putter head, a pair of spaced aligning or "sighting" members which have the function of assisting the golfer to align the ball with the line to the hole.

By "striking face of the putter" is hereby meant that face of the putter which is substantially planar and contacts the ball when putting.

Whilst the putter of the aforesaid document may provide some assistance for the golfer, the device has several drawbacks. Firstly, the putter head alignment means, i.e. the rearwardly projecting "sights", are designed to give a point of convergence several feet in front of the putter's striking face. This construction, in particular for golfers having problems with concentration, may have a somewhat detrimental effect since the golfer has to concentrate his attention on the ball in order to hit it cleanly, on a point some feet away given by the sights and also on the hole itself (in order to control the motive force for putting the ball the correct distance). An additional drawback is that the golfer must imagine the lines of sight provided by the aiming means extending through the putter head itself, since the sighting means connect with the putter at points spaced inwardly from the outer edges of the putter. This naturally provides an additional means of distraction for the golfer.

Further examples of golf putters having alignment means thereon are also known for example from U.S. Pat. No. 3,921,984, U.S. Pat. No. 4,650,191 and U.S. Pat. No. 4,741,535.

One further object of the invention is to use the surface of the ball itself to assist in lining up the way to the hole. Many players use the markings on a golf ball to help them align their putts with the line to the hole, since the ball may be picked up whilst on the putting green (e.g. for cleaning) and replaced in a new orientation at the same location. However, whilst this is claimed to result in increased putting accuracy, full use of all alignment potential of the ball is not in fact effected.

SUMMARY OF THE INVENTION

The present invention seeks to solve the above-mentioned objects and problems by providing a putter having aiming means which better assist the golfer by making maximum use of all aiming assistance means available, without causing a distraction for the golfer and more importantly actually focusing the golfer's attention on the aiming means.

By arrangement of the aiming assisting means of this invention, not only is the player able to line up the putter with the marking on the golf ball (as previously), but two points on the circumference of the ball assist in "forming" the virtual arrowhead consisting of the extension of the aiming portions. In this way, the player is able to concentrate his attention on a minimal area around the ball in order to align the putter head and to putt the ball with a clean contact. Thus the player, having taken up his or her putting position, merely has to judge the distance to the hole and then look directly back to the ball without necessarily concentrating additionally on a point a few feet away as well.

Preferred embodiments and further features and advantages of the invention will become apparent to the skilled man upon reading the following description.

BRIEF DESCRIPTION OF THE DRAWINGS

A non-limiting embodiment of the invention will now be described with reference to the accompanying drawings in which.

DETAILED DESCRIPTION OF A PREFERRED EMBODIMENT

Figure 1:
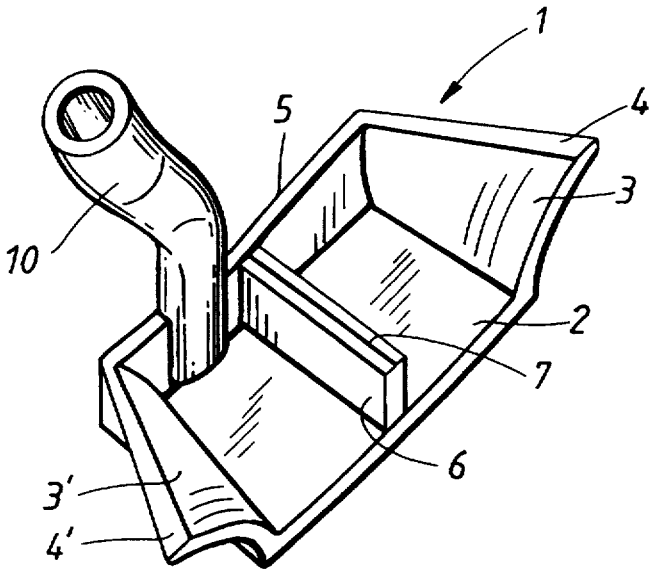
FIG. 1 shows a perspective view of the putter head from above and behind.

The putter head 1 shown in FIG. 1 comprises a base portion 2 integrally attached to two side portions 3, 3' and a front portion having a striking face 5. Thus the basic form of the putter head is a hollow member open at the rear side. In the embodiment shown, the head itself is a one piece unit cast in a suitable metal, although it is clear that the putter head could be made up of several types of material or individual portions appropriately adjoined with each other. Substantially in the middle of the putter there is positioned an upstanding web 6 having a line 7 inscribed or otherwise marked visibly thereon. This line is to indicate to the golfer where the "sweet-spot" of the putter is located, when viewing from above, which would correspond to the putting position.

Since in the preferred embodiment the head is symmetrical, the line 7 will be positioned midway between the ends of the planar striking face 5. The planar striking face itself may also be slanted as shown in FIGS. 3 and 4 for example.

Figure 3:
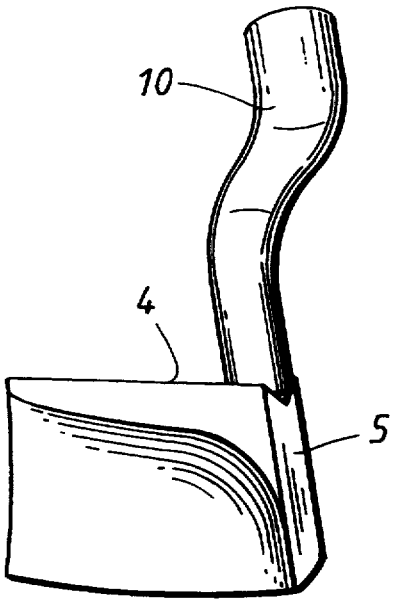
FIG. 3 shows a side-view taken from a position slightly forward of the striking face.
Figure 4:
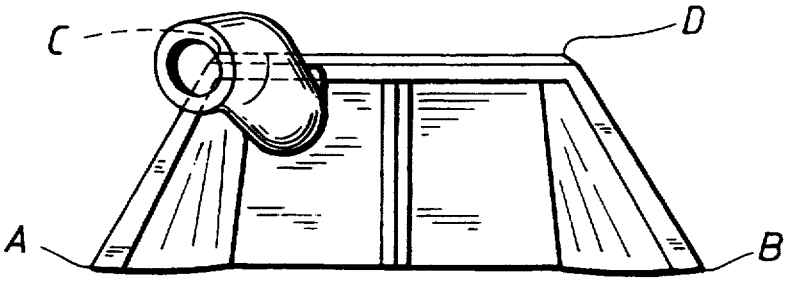
FIG. 4 shows a plan view of the putter head.

The upper edges 4 and 4' of side portions 3 and 3' are essentially planar and may have an inclination upwards from front to back as shown in FIG. 3 for example. However, the importance of the angle that these lines 4 and 4' make with the striking face 5 and also the distance apart of the rearmost point of each of these lines are important aspects of the invention and will be explained further on. Thus the upper edges or lines 4 and 4' need not be planar, but as seen from above must present substantially straight sections.

Figure 2:
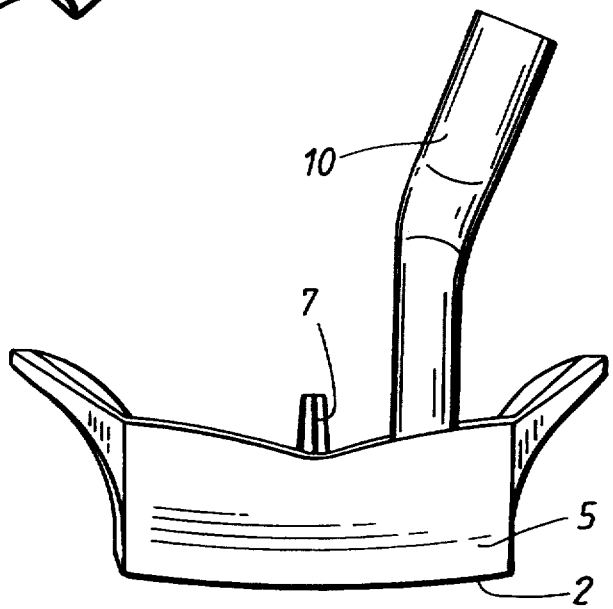
FIG. 2 shows a frontal view, marginally from above in order to depict detail.

As can be seen more clearly in FIG. 2, the underside of the base portion is slightly convex, with the lowest point being substantially in line with the line 7. In this way, rotational forces on the putter head caused by imperfect movement of the putter, such that the center of the head is not the lowest point, are reduced especially at the edges where the rotational torque is at its greatest. Alternatively the putter head can have a planar base. Similarly the underside of the putter may also be convex as shown in FIG. 3 for example.

To the head 1 is also affixed, or integral therewith, a hollow coupling or support stem 10 for fitting to a putter shaft (not shown).

Figure 5:
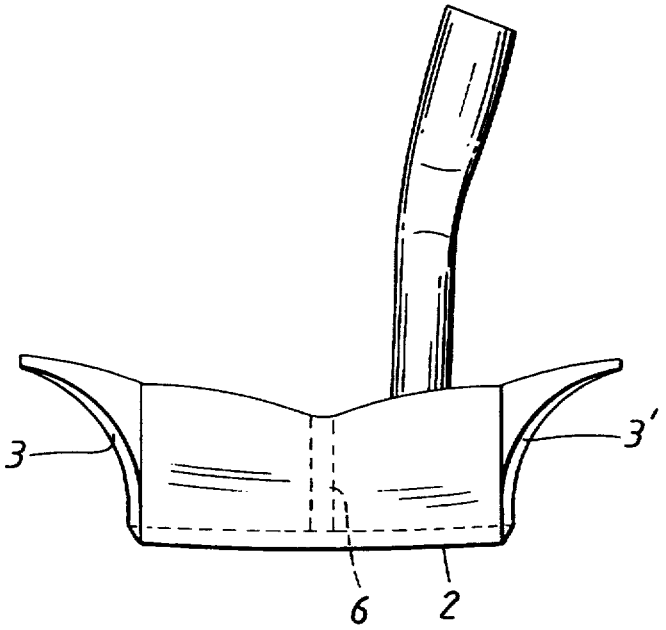
FIG. 5 shows a plan view on to the striking face.

FIG. 5 is a true front view of the putter head (not full scale however) and shows, as hidden detail, the web 6 and the upper surface of the base 2.

As is clear from FIGS. 1, 2 and 5 particularly, the side portions 3 and 3' are shaped in curvilinear fashion upwardly and outwardly from the base. This is preferable from an aesthetic point of view, but also helps to give a more pronounced arrow effect as seen from above, which as will be explained, helps to aim the putter head towards the hole.

Figure 6:
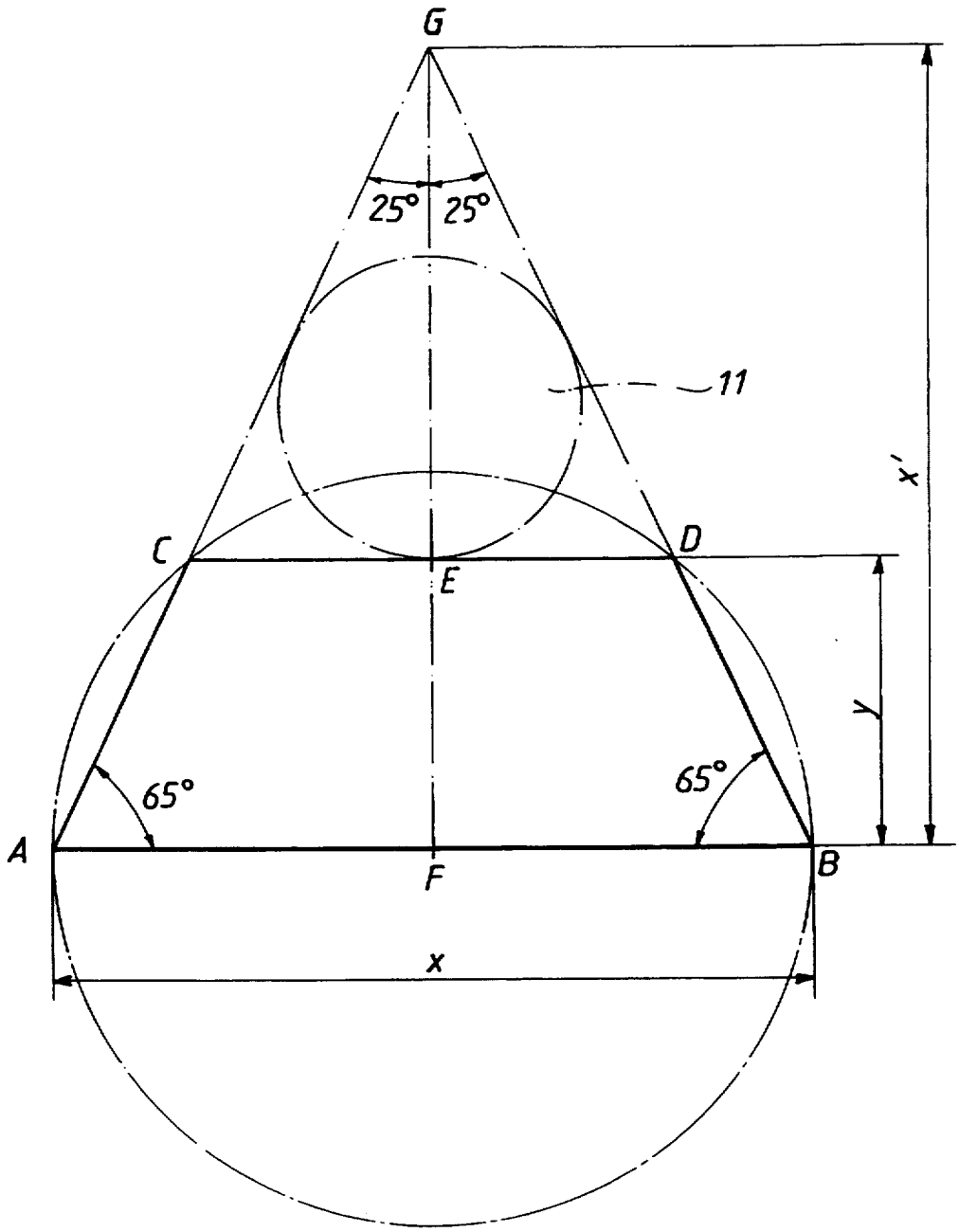
FIG. 6 shows a schematic plan view of the putter head ABCD from above, positioned over a golf hole having center F.

In FIG. 4, four points A, B, C and D have been identified on the putter head seen from above. When the putter head is placed as shown in FIG. 6 over an imaginary golf hole, the points A and B (the rearmost points of the putter sides) will be a distance apart corresponding to the diameter "x" of said golf hole. According to present golf regulations, this dimension is 108 mm. Thus the preferred distance between points A and B is substantially 108 mm.

The lines AC and BD (corresponding to upper edges 4' and 4 respectively) are to be used as aiming guides for forming an arrow pointing to the correct line for putting the ball to the hole (allowing for break on the green of course). This is achieved in that the back of the putter (line AB) and the lines AC and BD, extended to their virtual intersection at point G, will form a virtual arrow ABG. Additionally the lines AG and BG are arranged substantially tangential to a standard golf ball 11, placed at the striking face 5 of the putter.

The concept of a "standard" golf ball may require some brief explanation since the rules of golf only state that a golf ball should have a minimum diameter of 42.67 mm (1.68 inches) and a maximum weight of 45.93 g. Thus, no perfect definition of a standard golf ball exists. However, most golf balls are very close to the stated dimension and minor variations of the diameter of the golf ball will not affect the function of the invention to any great extent.

What is achieved by this substantial tangentiality using the sides of the ball is that the golfer is more easily able to visualise the full extent of the whole arrow ABG. When one compares this with the two aiming guides provided in the aforementioned U.S. Pat. No. 4,034,989 for example, it is clear that a significant assistance is provided to the golfer by using more indication points for forming the triangle.

The diagram of FIG. 6 also shows a distance "x'" corresponding to line GF. This distance is normally equal to the length "x" (the diameter of a golf hole) and thus allows the width "y" of the putter EF to be arrived at in order that all conditions should be fulfilled for the desired "tangential" arrow ABG. However, the distance GF may be chosen such that the line CD is marginally closer to AB than depicted. In such a case, points C and D will not lie on the circle with center F, but lines ACG and BDG will however still be straight lines. The preferred width of the putter head thus lies substantially between 40 and 45 mm, and preferably at 42 mm, but variations are of course possible.

The significance of the distance between points A and B being substantially that of a golf hole is found in the concept of the so-called "railway track" leading to the hole. In accordance therewith, the golfer uses points A and B to assist in the visual imagination of the start of two parallel tracks (like a railway track) to the hole. The invention assists moreover here in that the line FE which will be readily visualised will provide a further indicator to help this particular visualisation by being a further track aligned with middle of the hole. Such is particularly important for so called straight putts (no break) when the railway track principle with extra guide line FE can be used most easily.

Thus the base angles of the triangle ABG thus formed will be between about 63° to 67°, about 65° being preferred. However, as stated, small deviations from this of the order of a few degrees are only of minor importance.

This inventive construction of the putter head can also be improved in terms of balance in that said putter head with integral support stem is weighted such that, when fitted to a straight putter shaft and with the thus-formed putter supported at its balance point on the shaft, said putter head remains substantially horizontal.

Many variations of the putter head are imaginable and the invention is not limited to the above described embodiment but can be varied to a great degree within the spirit and scope of the appended claims.

What is claimed is:

1. Putter head for a golf putter, said putter head comprising a planar striking face and aiming assisting means, wherein said aiming assisting means comprise two aiming portions each having a straight edge, to thus form two straight-edged aiming portions each extending in a rearward direction with respect to said striking face and from a location common with said striking face and wherein, seen from above and in said rearward direction, said two straight-edged aiming portions diverge outwardly, each of said two straight-edged aiming portions having an axis extending therethrough and aligned therewith, both of the axes extending forward of said planar striking face and being substantially tangential to a golf ball placed at said striking face.

2. The putter head according to claim 1, wherein each of said aiming portions has a rearmost point, the rearmost point of one of said aiming portions being separated from the rearmost point of the other by a distance of substantially 108 mm.

3. The putter head according to claim 1 or claim 2, wherein said aiming portions are formed in one piece with said putter head.

4. The putter head according to claim 3, wherein the width of the putter between the striking face the rearmost point is approximately 40 to 45 mm.

5. The putter head according to claim 1 or claim 2, wherein said putter head has a locating line positioned substantially at the center of said putter head.

6. Putter head according to claim 1 or claim 2, wherein said putter is formed as a hollowed out member having a center-locating reference line positioned substantially perpendicular to said striking face and along an upstanding web in a middle portion of said hollowed out member.

7. The putter head according to claim 2, wherein said axes converge at a convergence point, the distance between the convergence point and the center of a line joining said rearmost points of said aiming portions being substantially 108 mm.

8. Putter head for a golf putter, said putter head comprising a planar striking face and aiming assisting means, wherein said aiming assisting means comprise two aiming portions each having a straight edge, to thus form straight-edged aiming portions each extending in a rearward direction with respect to said striking face and from a location common with said striking face and wherein, seen from above and in said rearward direction, said two straight-edged aiming portions diverge outwardly, each of said two straight-edged aiming portions having an axis extending therethrough and aligned therewith, both of the axes extending forward of said planar striking face and being substantially tangential to a golf ball placed at said striking face, said putter head further comprising an integral hollow support stem for receiving a putter shaft.

9. The putter head according to claim 8, wherein said putter head with integral support stem is weighted such that, when fitted to a putter shaft to form a putter and with the putter supported at its balance point on the shaft, said putter head is balanced to remain substantially horizontal.

10. The putter head according to claim 1 or claim 8, wherein the striking face of said putter head has a length defined by two outer edges and wherein said at least two aiming portions meet the putter striking face substantially at said outer edges, so that an outer edge of each aiming portion has a real point of intersection with a respective one of the outer edges of the striking face.

11. Golf putter having a shaft and a putter head connected thereto, said putter head comprising a planar striking face and aiming assisting means, wherein said aiming assisting means comprise two aiming portions each having a straight edge, to thus form straight-edged aiming portions each extending in a rearward direction with respect to said striking face and from a location common with said striking face and wherein, seen from above and in said rearward direction, said two straight-edged aiming portions diverge outwardly, each of said two straight-edged aiming portions having an axis extending therethrough and aligned therewith, both of the axes extending forward of said planar striking face and being substantially tangential to a golf ball placed at said striking face.

12. The putter head according to claim 1, wherein the axes passing through the straight-edged aiming portions are substantially tangential to a golf ball having a diameter of 1.68 inches.

13. The putter head according to claim 8, wherein the axes passing through the straight-edged aiming portions are substantially tangential to a golf ball having a diameter of 1.68 inches.

14. The golf putter according to claim 11, wherein the axes passing through the straight-edged aiming portions are substantially tangential to a golf ball having a diameter of 1.68 inches.

* * * * *